US007934782B2

(12) United States Patent
Christie

(10) Patent No.: US 7,934,782 B2
(45) Date of Patent: May 3, 2011

(54) HINGE SYSTEM

(76) Inventor: Steven J. Christie, Ottawa (CA)

( * ) Notice: Subject to any disclaimer, the term of this patent is extended or adjusted under 35 U.S.C. 154(b) by 909 days.

(21) Appl. No.: 11/538,536

(22) Filed: Oct. 4, 2006

(65) Prior Publication Data

US 2007/0145871 A1 Jun. 28, 2007

(30) Foreign Application Priority Data

Oct. 4, 2005 (CA) ..... 2522167

(51) Int. Cl.
*A47B 96/00* (2006.01)

(52) U.S. Cl. ..... 312/296; 16/361

(58) Field of Classification Search ..... 312/326, 312/329, 257.1, 100, 109, 138.1, 293.2, 319.1, 312/296; 16/357, 361, 239; 49/245, 254, 49/258

See application file for complete search history.

(56) References Cited

U.S. PATENT DOCUMENTS

| | | | | | |
|---|---|---|---|---|---|
| 154,995 | A * | 9/1874 | Tripp | 16/361 |
| 375,459 | A * | 12/1887 | Pettigrew | 114/203 |
| 1,122,322 | A * | 12/1914 | Smith | 16/292 |
| 1,448,444 | A * | 3/1923 | Hollingshead | 16/361 |
| 1,864,164 | A * | 6/1932 | Aldeen | 16/360 |
| 2,777,156 | A * | 1/1957 | Weisgarber | 16/361 |
| 3,207,565 | A * | 9/1965 | Scharge | 312/204 |
| 3,479,104 | A * | 11/1969 | Kobryner | 312/229 |
| 3,566,434 | A * | 3/1971 | Grinsteiner | 16/66 |
| 3,588,946 | A * | 6/1971 | Macdonald | 16/224 |
| 3,624,862 | A * | 12/1971 | Litle | 16/278 |
| 3,835,585 | A * | 9/1974 | Anderson et al. | 49/398 |
| 3,842,542 | A * | 10/1974 | White et al. | 49/386 |
| 4,091,501 | A * | 5/1978 | Lautenschlager et al. | 16/357 |
| 4,177,540 | A * | 12/1979 | Gorton | 16/335 |
| 4,799,290 | A * | 1/1989 | Lautenschlager, Jr. | 16/237 |
| 4,884,317 | A * | 12/1989 | Liu | 16/289 |
| 4,987,640 | A * | 1/1991 | Lin | 16/327 |
| 5,218,739 | A * | 6/1993 | Lautenschlager | 16/335 |
| 5,486,664 | A * | 1/1996 | Lamp et al. | 200/297 |
| 5,500,983 | A * | 3/1996 | Lautenschlager | 16/304 |
| 5,535,482 | A * | 7/1996 | Grabber | 16/286 |
| 5,867,871 | A * | 2/1999 | Tasman | 16/335 |
| 5,909,937 | A * | 6/1999 | Jenkins et al. | 312/405.1 |
| 6,575,046 | B1 * | 6/2003 | Redington | 73/861.74 |

* cited by examiner

*Primary Examiner* — James O Hansen
(74) *Attorney, Agent, or Firm* — Anderson Gorecki & Manaras LLP

(57) ABSTRACT

The present invention relates to electrical enclosures having a cabinet and a door connected by hinges and in particular to a hinge which allows a door, while closed, to be flush with a surface that surrounds the perimeter of the cabinet door opening. The hinge system utilizes a spring that pushes the door in a direction that is generally normal to and away from the cabinet, creating a space between the peripheral flange on the door and the surface that surrounds the cabinet door opening thus allowing the door to swing freely as it is opened and closed. The door can be held closed by use of various latching systems. While the door is in the closed position, latches near the hinges will compress the hinge springs, eliminating the space between the door and the cabinet opening.

8 Claims, 6 Drawing Sheets

HINGE SYSTEM

CROSS-REFERENCE TO RELATED APPLICATIONS

This application is based upon and claims the benefit of the filing date of Canadian Patent Application Serial No. 2,522,167 filed on Oct. 4, 2005.

FIELD OF INVENTION

The present invention relates to electrical enclosures having a cabinet and a door connected by hinges and in particular to a hinge which allows a door, while in a closed position, to be flush with a surface that surrounds the perimeter of the cabinet door opening.

BACKGROUND OF THE INVENTION

Electrical enclosures generally consist of a cabinet and a door connected by hinges. To strengthen the door, typically it is folded in the shape of a pan. That is, the door is a flat panel surrounded by edges that form a peripheral flange. To strengthen the door opening side of the cabinet, at least one surface is formed around the perimeter of the cabinet door opening. The length of the peripheral flange on the door is designed to create a space between the edge of that flange and the surface that surrounds the perimeter of the cabinet door opening. This allows the door to swing freely as it is opened and closed.

That is, a typical hinge system causes the door to swing in an arc, so there must be sufficient clearance between the peripheral flange of the door, and the perimeter of the cabinet door opening to avoid scraping, jambing or other interference.

Elimination of the space between the edge of the peripheral flange and the surface that surrounds the perimeter of the door opening is advantageous because it provides for better protection of the inside of the cabinet from external contaminants. Other approaches in the art of electrical enclosure hinge systems do not eliminate the requirement for a space between the edge of the peripheral flange on the door and the surface that surrounds the cabinet door opening.

There is therefore a need for an improved hinge system.

SUMMARY OF THE INVENTION

The present invention is a hinge system that eliminates the need for a space between the peripheral flange on the door and the surface that surrounds the cabinet door opening while the door is closed.

The hinge system utilizes a spring that pushes the door in a direction that is generally normal to and away from the cabinet when it is unlatched. In the unlatched position, a space is created between the peripheral flange on the door and the surface that surrounds the cabinet door opening, allowing the door to swing freely as it is opened and closed. The door can be held closed by using various latching systems that employ at least one latch to hold the door in a closed position. While the door is in the closed position, similar latches are also employed near the hinges to compress one or more hinge system springs thus eliminating the space between the peripheral flange on the door and the surface that surrounds the perimeter of the cabinet door opening.

According to an aspect of the present invention there is provided an enclosure comprising: a cabinet having an opening; a door having a peripheral flange sized to surround the perimeter of the opening in the cabinet; two or more hinges pivotally connecting the door to the cabinet, and arranged to align the door with the cabinet opening while the door is in a closed position, each of the hinges comprising: a door component and a cabinet component, each of the door components being fastened to the door, and each of the cabinet components being fastened to the cabinet; displacement means for displacing the door toward and away from the cabinet in a direction generally normal to the plane of the opening in the cabinet; and biasing means for urging the door away from the opening in the cabinet; and one or more latches for compressing the biasing means and reducing the space between the door and the cabinet while the door is in the closed position; whereby on opening, the door may be displaced away from the cabinet before being pivoted, avoiding interference between the peripheral flange of the door and the perimeter of the cabinet.

According to another aspect of the present invention there is provided a hinge for pivotally attaching a door to a cabinet having an opening, the hinge comprising: a door component and a cabinet component, each of the door components being arranged to be fastened to the door, and each of the cabinet components being arranged to be fastened to the cabinet; displacement means for displacing the door toward and away from the cabinet in a direction generally normal to the plane of the opening in the cabinet; and biasing means for urging the door away from the opening in the cabinet.

According to a further aspect of the present invention there is provided a hinge for pivotally attaching a door to a cabinet having an opening, the hinge comprising: a door component and a cabinet component connected together with a hinge pin, each of the door components being arranged to be fastened to the door, and each of the cabinet components being arranged to be fastened to the cabinet; at least one slot which slidably engages with the hinge pin, allowing the door to be displaced toward and away from the cabinet in a direction generally normal to the plane of the opening in the cabinet; and a spring for urging the door away from the opening in the cabinet.

Other aspects and features of the present invention will be apparent to those of ordinary skill in the art from a review of the following detailed description when considered in conjunction with the drawings.

BRIEF DESCRIPTION OF THE DRAWINGS

These and other features of the invention will become more apparent from the following description in which reference is made to the appended drawings wherein.

Similar reference numerals may have been used in different figures to denote similar components.

DETAILED DESCRIPTION

One or more currently preferred embodiments have been described by way of example. It will be apparent to persons skilled in the art that a number of variations and modifications can be made without departing from the scope of the invention as defined in the claims.

Figure 1:
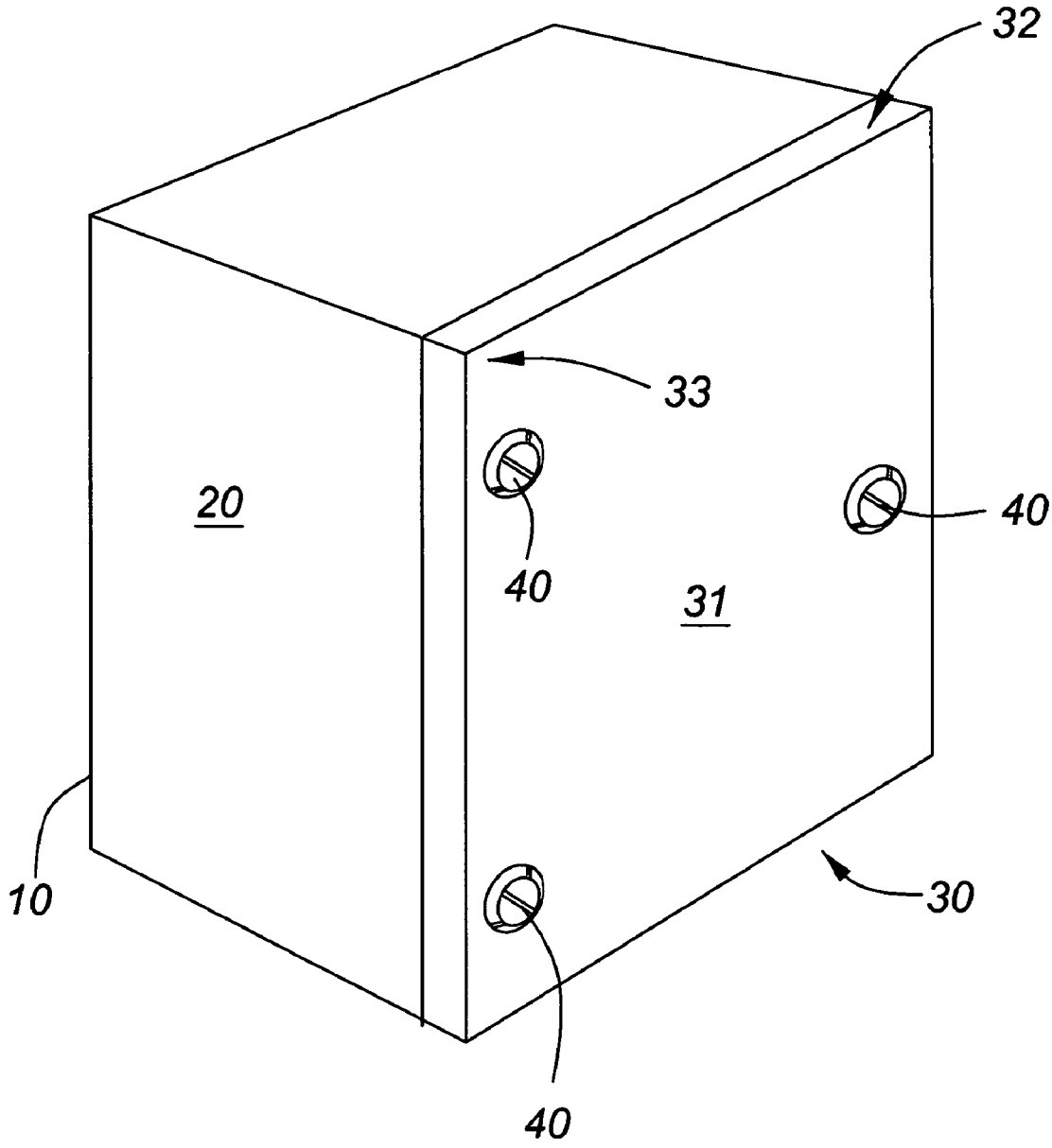
FIG. 1 presents a perspective view of an electrical enclosure in an embodiment of the invention.
Figure 2:
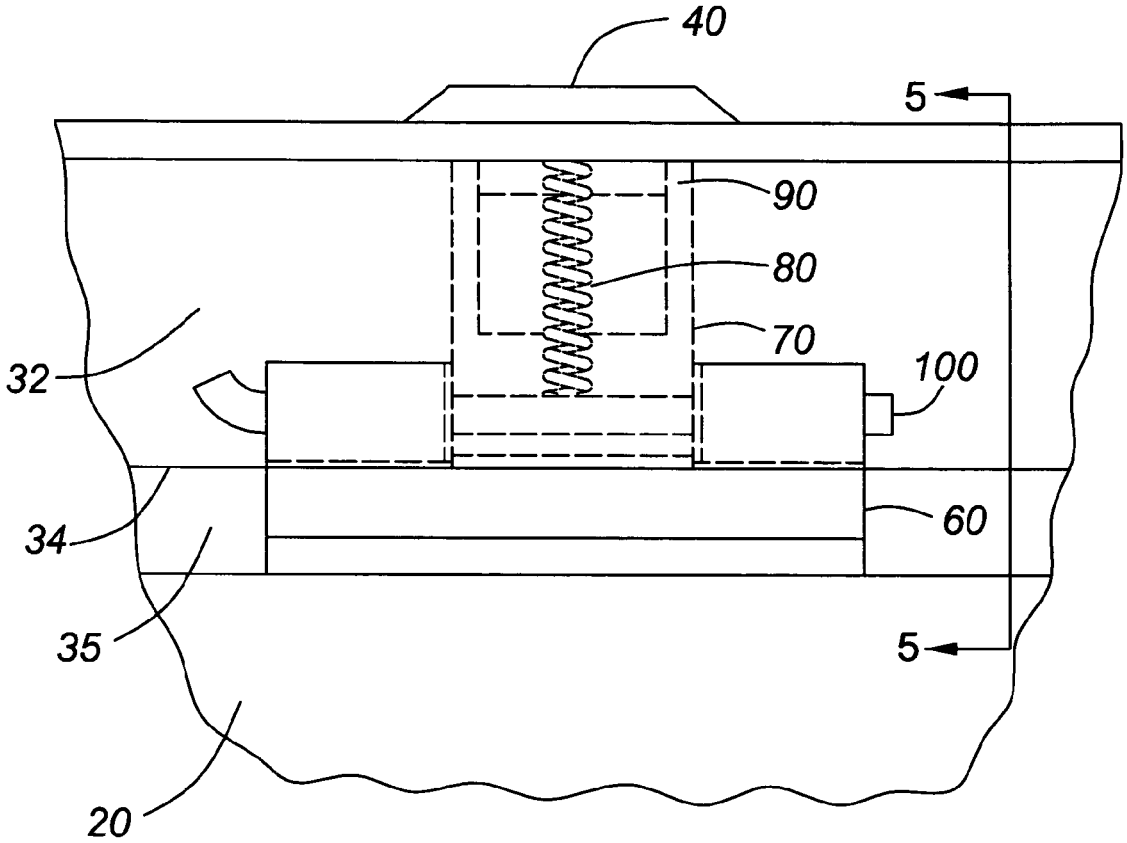
FIG. 2 presents an enlarged fragmentary view taken from the side of the enclosure of FIG. 1 showing one hinge and portions thereof in phantom with a space between the edge of the peripheral flange of the door and the front face of the cabinet in an embodiment of the invention.
Figure 3:
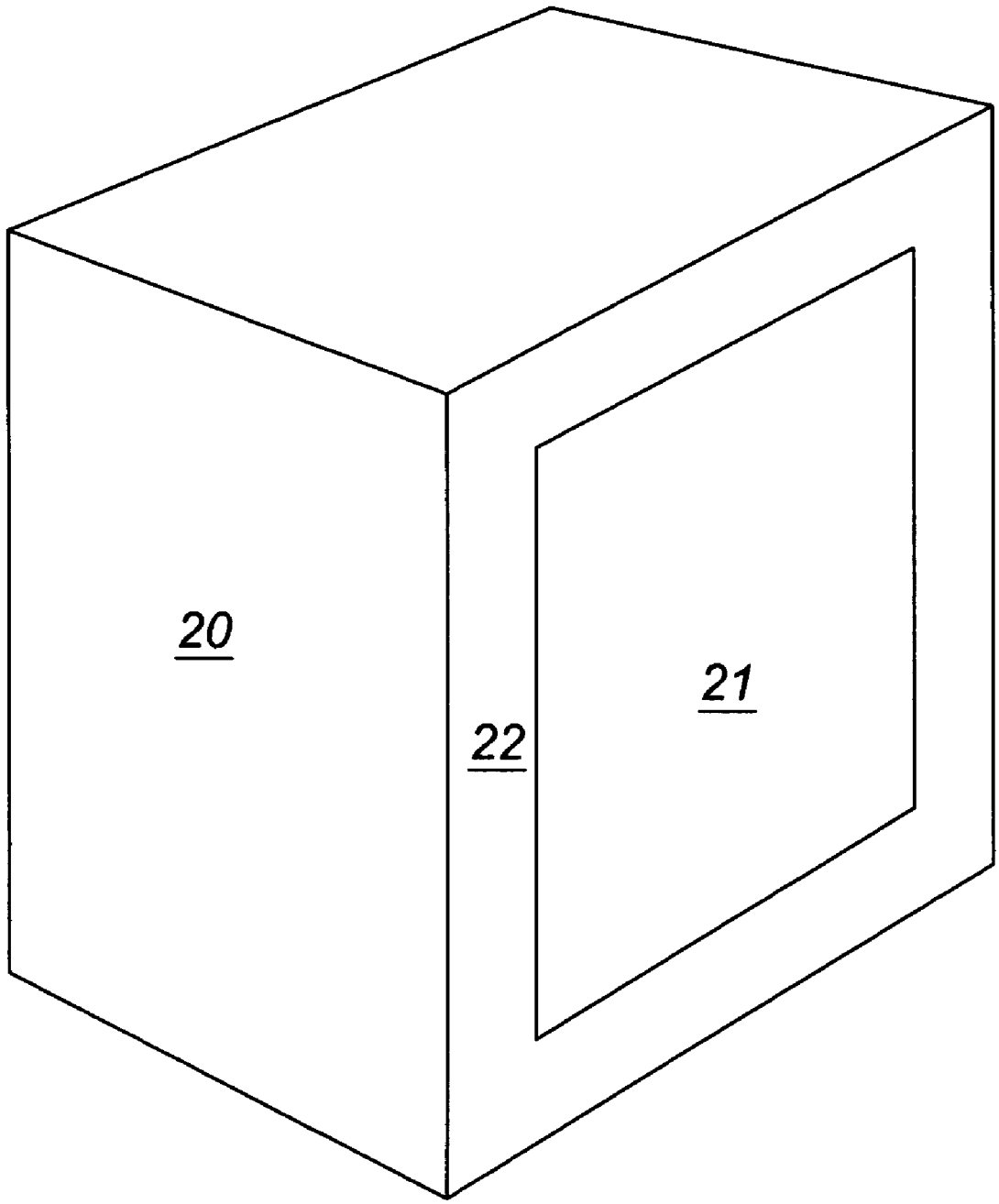
FIG. 3 presents a perspective view of an electrical enclosure cabinet in an embodiment of the invention.

FIG. 1 presents an electrical enclosure generally designated 10 that comprises a cabinet (20) and a door (30) which are connected by a hinge system (50). An exploded view of the hinge system (50) is shown on FIG. 4. The door (30) is held closed with at least one latch (40). FIG. 3 presents the cabinet (20) with a door opening (21) on at least one side. On the same side of the door opening (21) is a front face (22) that borders the perimeter of the door opening (21). The purpose of the front face (22) is to strengthen the cabinet (20). The door (30) is typically constructed from a single sheet of aluminum or steel and is a flat panel (31) surrounded by edges that form a peripheral flange (32). The peripheral flange (32) is welded or otherwise secured at each corner (33) of the rectangle. Of course, the invention may be implemented with other cabinet and door constructions, including for example: stainless steel, cast aluminum, fiberglass, PVC (polyvinyl chloride) and other similar metallic or non-metallic materials.

Figure 4:
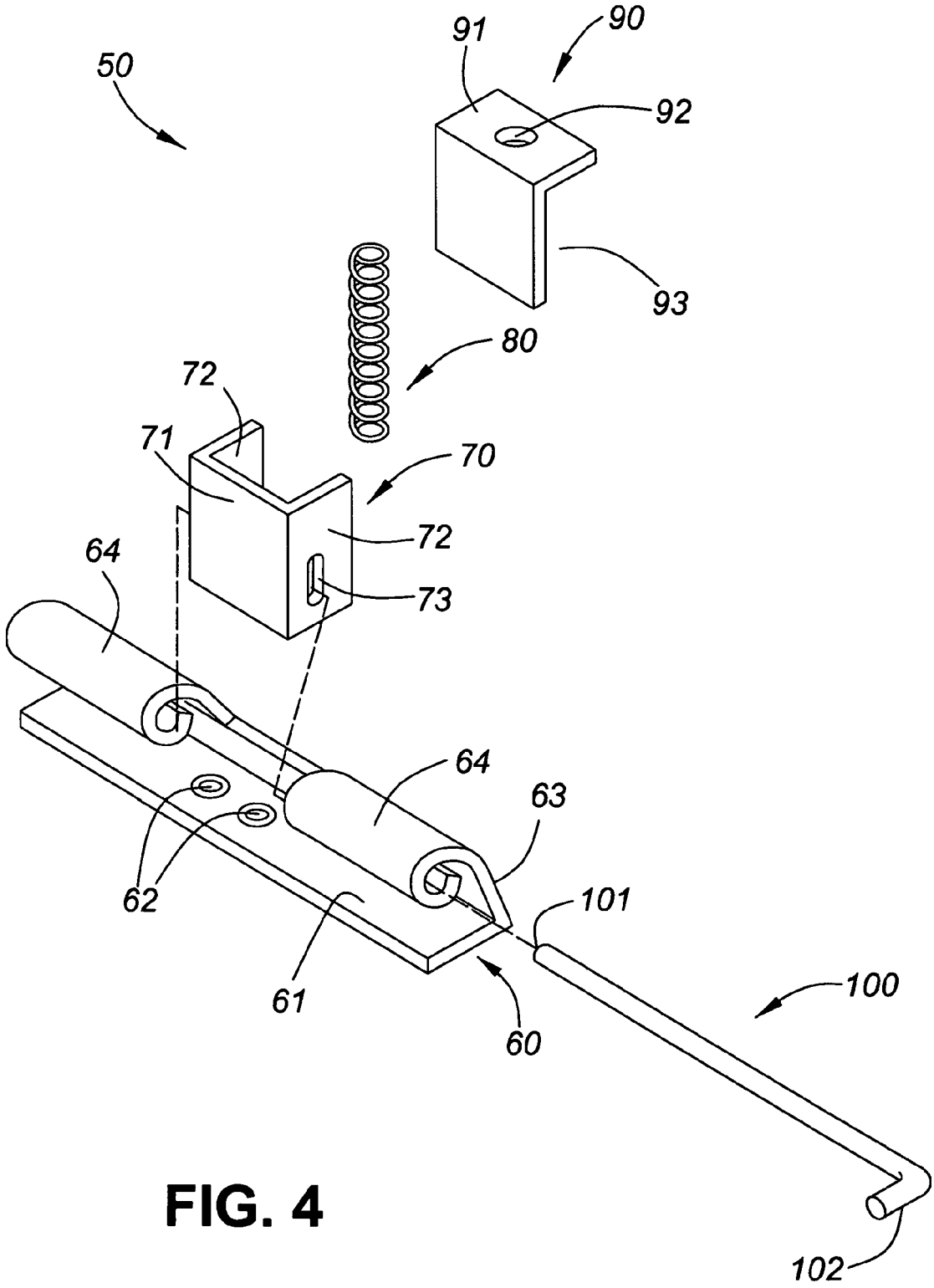
FIG. 4 presents an exploded perspective view of a hinge system in an embodiment of the invention.

FIG. 4 presents an exploded perspective view of the hinge system (50) that includes a cabinet component (60), a door component (70), at least one spring (80), a spring retainer (90), and a hinge pin (100). The cabinet component (60) consists of a base (61) with at least one hole (62) that provides a means of fastening the cabinet component (60) to the cabinet (20). The cabinet component (60) is secured to the cabinet (20) with a screw, bolt, rivet, weld or other similar mounting member. A riser (63) is mounted to the base (61) and generally extends upward. Two knuckles (64) are mounted to the riser (63) and generally extend inward such that their position is above the base (61). The knuckles (64) each form a tube. The knuckles (64) are aligned to accommodate the insertion of a hinge pin (100). The door component (70) also consists of a base (71) that can be welded or otherwise fastened to the inside of the peripheral flange (32) of the door (30). Mounted to the base (71) are two risers (72) that extend in a direction that is substantially normal to the surface of the base (71). Each riser (72) contains a slot (73). The slots (73) are also aligned to accommodate insertion of the hinge pin (100).

The spring (80) shown is a coil spring with its ends ground flat. However, it can be appreciated that other spring configurations can be substituted for the spring (80) shown to achieve the same purpose. For example, one could use conical springs, leaf springs, buckling-column springs, elastomers and the like. Alternatively, one could rely on an elastomer gasket between the door and the cabinet, though that would be less effective. As well, one could use two or more of any of these kinds of springs. The spring retainer (90) consists of a base (91) that has a hole (92) which provides a means of mounting the spring retainer (90) to the inside flat panel (31) of the door (30). The spring retainer (90) is secured to the door (30) with a weld, screw, or other mounting member. A riser (93) is mounted to the base (91) and extends in a direction that is substantially normal to the surface of the base (91). The hinge pin (100) has a tapered portion (101) at one end and a stopping portion (102) at the other end. It can be appreciated that the stopping portion (102) may be formed in a variety of configurations.

Figure 5A:
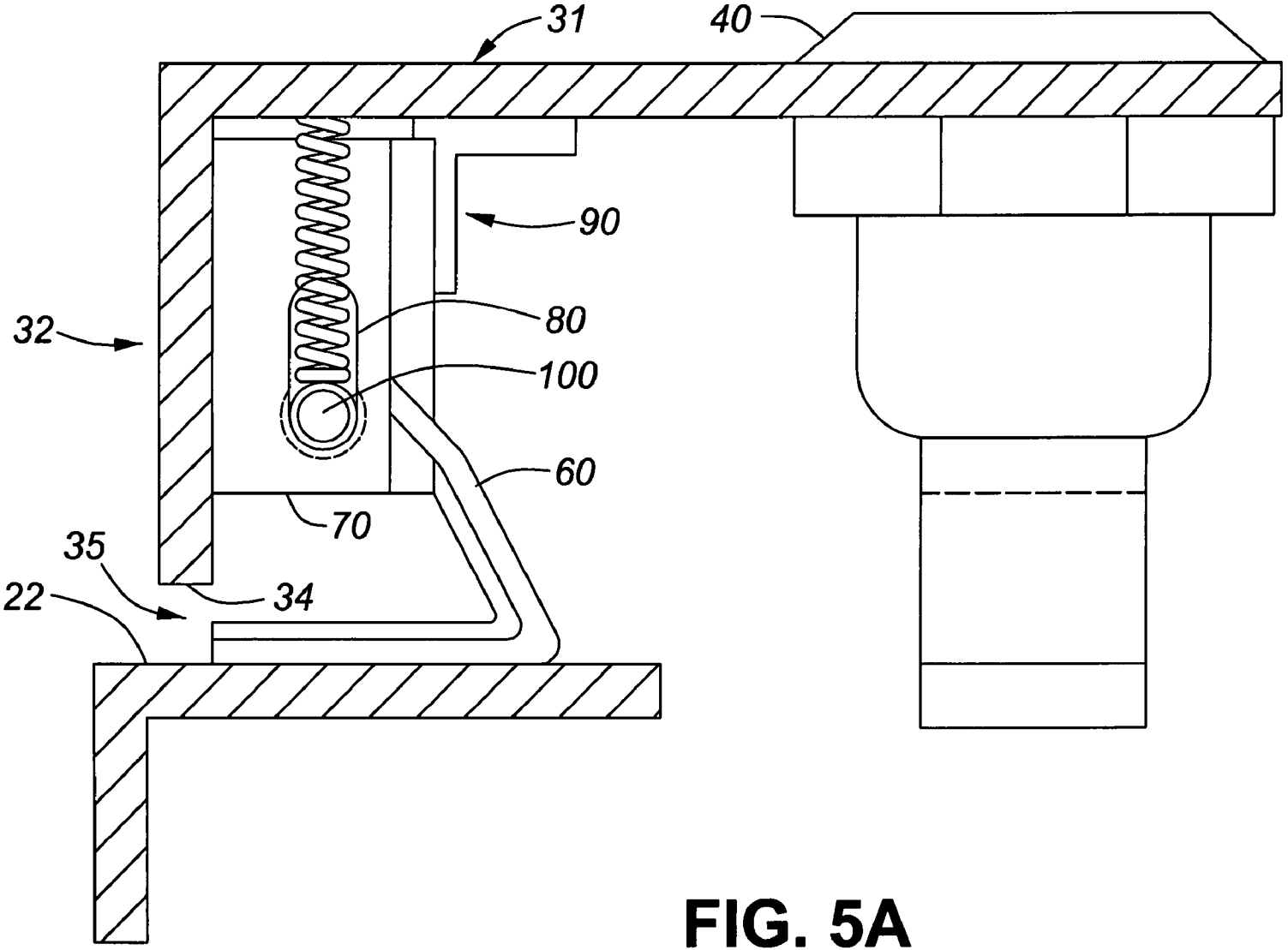
FIG. 5A presents a front sectional view taken along line 5-5 of FIG. 2 with a space between the edge of the peripheral flange of the door and the front face of the cabinet created by the hinge system spring.
Figure 5B:
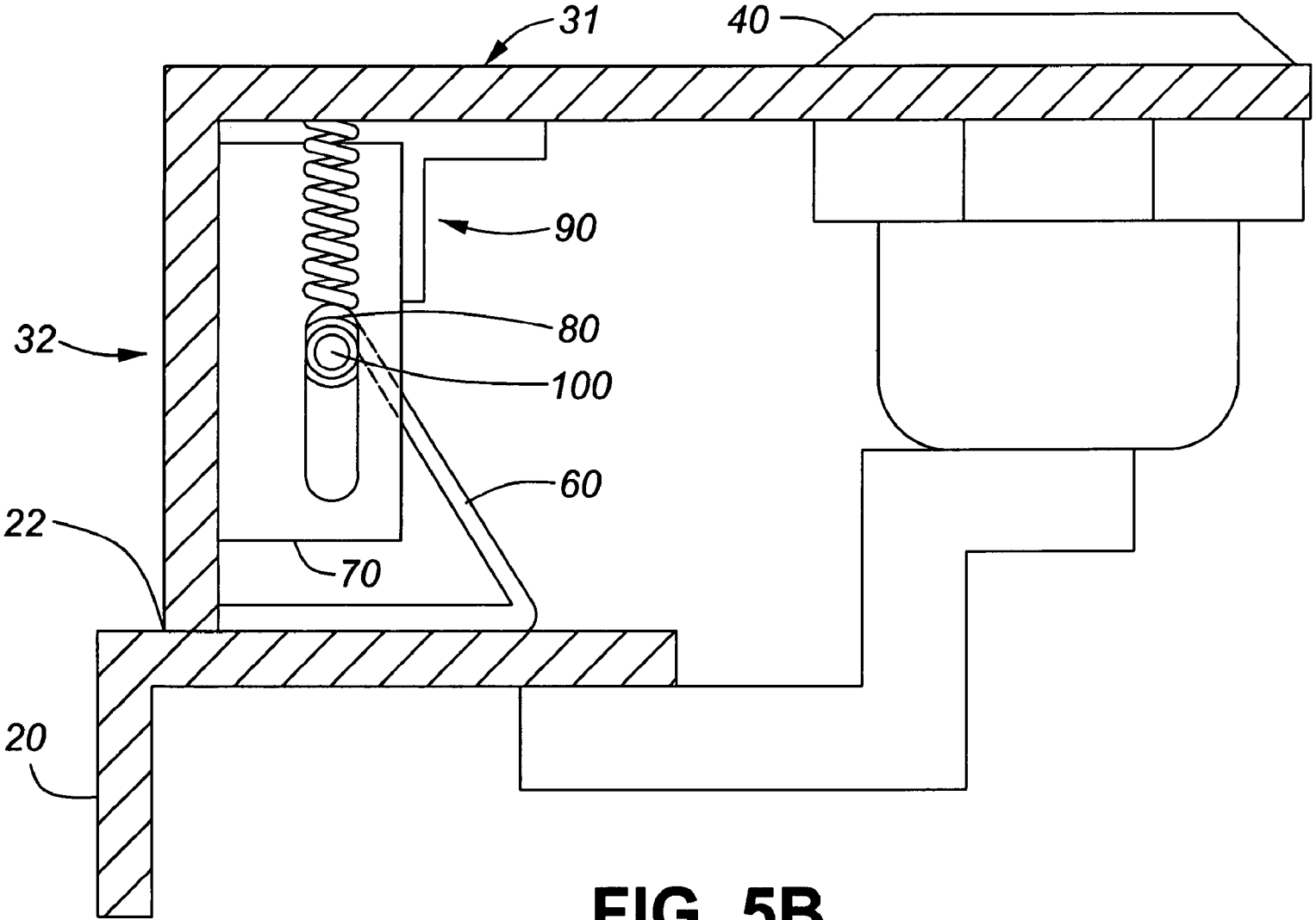
FIG. 5B presents a front sectional view taken along line 5-5 of FIG. 2 with no space between the edge of the peripheral flange of the door and the front face of the cabinet.

FIGS. 5A-5B show a cross section of the cabinet (20) and the door (30) with the cabinet component (60) and the door component (70) married together with the hinge pin (100). The spring (80) is inserted between the hinge pin (100) and the inside of the flat panel (31) of the door (30). The spring (80) is held in place with the spring retainer (90). The spring (80) force has the effect of pushing the door (30) away from the front face (22) of the cabinet (20). This allows the door (30) to swing freely as the edge (34) of the peripheral flange (32) is unobstructed by the front face (22) of the cabinet (20). While the door (30) is in the closed position, a latch (40) or any means of latching can be used on the hinge side of the door (20) to compress the spring (80) thus eliminating the space (35) between the edge (34) of the peripheral flange (32) of the door (30) and the front face (22) of the cabinet (20) as shown in FIG. 5B.

The present invention has been described with regard to one or more embodiments. However, it will be apparent to persons skilled in the art that a number of variations and modifications can be made without departing from the scope of the invention as defined in the claims.

What is claimed is:

1. An enclosure comprising:

a cabinet having an opening;

a door having a peripheral flange sized to surround the perimeter of said opening in said cabinet;

two or more hinges pivotally connecting said door to said cabinet using hinge pins, and arranged to align said door with said cabinet opening while said door is in a closed position, each of said hinges comprising:

a door component and a cabinet component, each of said door components being fastened to said door, and each of said cabinet components being fastened to said cabinet;

one or more slots in each hinge for displacing said door toward and away from said cabinet in a direction generally normal to the plane of the opening in said cabinet; and a spring for urging said door away from said opening in said cabinet, said spring being inserted between said hinge pins and an inside of said door;

each of said cabinet components of said two or more hinges comprising:

a base that is secured to the cabinet;

a riser mounted to the base and generally extending upwards; and two knuckles mounted to the riser and positioned to be centered over the base;

each of said knuckles forming a tube and said two knuckles being aligned to accommodate insertion of one of the hinge pins; and each of said door components of said two or more hinges comprising:

a base that is secured to an inside of a peripheral flange of the door; and two risers extending normal to the surface of the base, each riser containing one of said one or more slots aligned to accommodate insertion of one of the hinge pins; and one or more latches for compressing said spring and reducing the space between the door and the cabinet while the door is in the closed position;

whereby on opening, said door is displaced away from said cabinet before being pivoted, avoiding interference between the peripheral flange of said door and the perimeter of the cabinet.

2. The enclosure of claim 1, wherein said spring is selected from the group consisting of: coil springs, conical springs, leaf springs, buckling-column springs and elastomers.

3. The enclosure of claim 1, wherein said cabinet and said door are fabricated from materials selected from the group consisting of: aluminum, steel, stainless steel, cast aluminum, fiberglass, and PVC (polyvinyl chloride).

4. The enclosure of claim 1, further comprising a spring retainer for holding the spring in place, said spring retainer comprising:

a base with means to mount the spring retainer to an inside flat panel of the door; and a riser mounted to the base and extending in a direction normal to the surface of the base.

5. A hinge for pivotally attaching a door to a cabinet having an opening, said hinge comprising:

a door component and a cabinet component, said cabinet component and said door component being pivotally connected using a hinge pin, said door component being arranged to be fastened to said door, and said cabinet component being arranged to be fastened to said cabinet;

one or more slots for displacing said door toward and away from said cabinet in a direction generally normal to the plane of the opening in said cabinet; and a spring for urging said door away from said opening in said cabinet;

said cabinet component comprising:

a base arranged to be secured to said cabinet;

a riser mounted to the base and generally extending upwards; and two knuckles mounted to the riser and positioned to be centered over the base;

the knuckles each forming a tube and being aligned to accommodate insertion of the hinge pin; and said door component comprising:

a base that is secured to an inside of a peripheral flange of the door; and two risers extending normal to the surface of the base, each riser containing one of said one or more slots aligned to accommodate insertion of the hinge pin.

6. The hinge of claim 5, wherein said spring is selected from the group consisting of: coil springs, conical springs, leaf springs, buckling-column springs and elastomers.

7. The hinge of claim 5, further comprising a spring retainer for holding the spring in place, said spring retainer comprising:

a base with means to mount the spring retainer to an inside flat panel of the door; and a riser mounted to the base and extending in a direction normal to the surface of the base.

8. The hinge of claim 7 wherein the spring is inserted between the hinge pin and the inside of the flat panel of the door.

* * * * *